United States Patent [19]

Huang

[11] Patent Number: 4,477,144

[45] Date of Patent: Oct. 16, 1984

[54] FEEDER CONNECTOR ASSEMBLY FOR COAXIAL CABLE

[76] Inventor: Chi-Hao Huang, 1, Chen Chung St., Chung Ho Li, Chang Hua City, Taiwan, 500

[21] Appl. No.: 357,797

[22] Filed: Mar. 12, 1982

[51] Int. Cl.[3] ..... H01R 17/18

[52] U.S. Cl. ..... 339/177 R; 339/147 R; 333/260

[58] Field of Search ..... 339/17 C, 17 LC, 147 R, 339/177 R, 177 E; 29/874, 882; 333/32, 260

[56] References Cited

U.S. PATENT DOCUMENTS

| | | | |
|---|---|---|---|
| 3,316,453 | 4/1967 | Lassers | 339/17 C |
| 3,327,253 | 6/1967 | Campbell | 333/32 |
| 3,989,333 | 11/1976 | Cauldwell | 339/17 C |

OTHER PUBLICATIONS

Fordham Radio Catalog, 1983, p. 175, 260 Motor Parkway, Hauppauge, NY 11788.

*Primary Examiner*—Eugene F. Desmond
*Assistant Examiner*—Steven C. Bishop
*Attorney, Agent, or Firm*—Burns, Robert E.; Emmanuel J. Lobato; Bruce L. Adams

[57] ABSTRACT

In a feeder connector assembly for a coaxial cable, a terminal board having a pair for terminals is mounted on a body portion attached to the cable end and housing a contact reed by means of a base board formed as a sheet metal stamping. The base board has an annular inner end portion which is bent at right angles and embraces an interrupted flange on the outer end of the base portion with projections received in notches in the flange. At its outer end the base board has lugs which are received in matching holes in the terminal board to secure the terminal board to the base board. On an intermediate portion of the base board there are spaced clamp portions stamped out of the sheet metal of the base board at right angles to hold a transformer between them. Also small endless portions of the sheet metal are stamped out of the plane of the base board to form protruding loops to hold capacitors.

6 Claims, 9 Drawing Figures

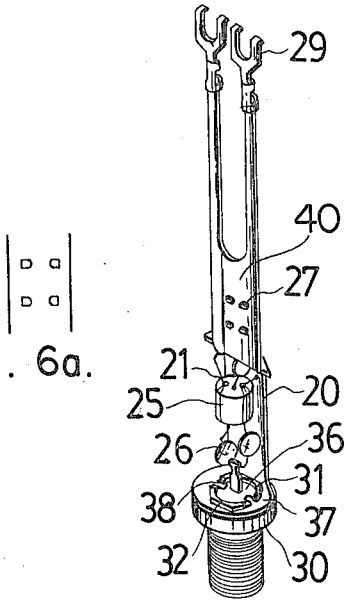
Fig. 6a.
Fig. 6.
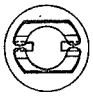
Fig. 6b.
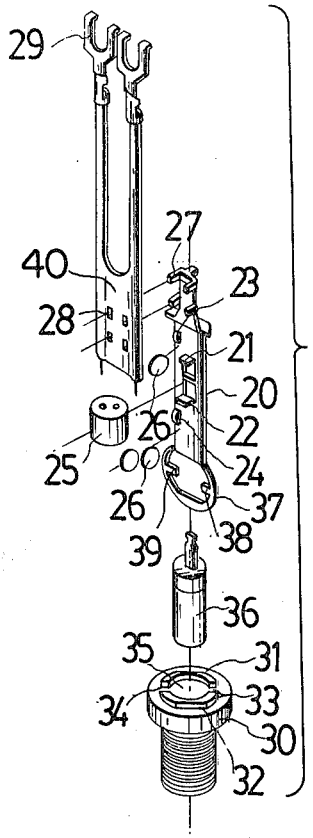
Fig. 5.
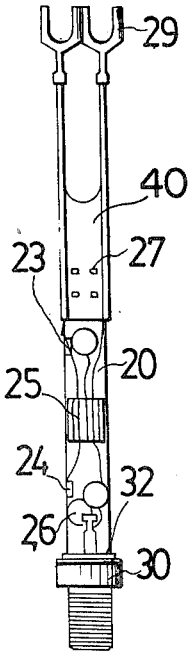
Fig. 7.

FEEDER CONNECTOR ASSEMBLY FOR COAXIAL CABLE

FIELD OF INVENTION

The present invention relates to an assembly for mounting a terminal board having a pair of terminals on an end of a coaxial cable in such manner as to provide greater convenience for processing and production and is thus suited for mass production.

BACKGROUND OF THE INVENTION

A conventional feeder connector for coaxial cables comprises essentially an insulated PC board soldered onto a connector body housing a contact reed blade. A converter comprising capacitors and a transformer are soldered onto the PC board. A pair of terminals is soldered to the converter. A connector of this kind is not secured very firmly on the connector body and can easily become dislocated.

SUMMARY OF THE INVENTION

It is an object of the present invention to provide a feeder connector assembly for a coaxial cable in which the terminals and other components are mounted more conveniently and more securely. In accordance with the invention, a base board comprising a sheet metal stamping is provided with an annular inner end portion which seats on a body portion of the assembly which is secured on an end of a coaxial cable and houses a contact reed. The sheet metal base board has stamped-out clamp portions for mounting a transformer and protruding loop portions for attachment of capacitors. Moreover, at its outer end the base board is provided with lugs which are received in matching holes of a terminal board for attaching the terminal board to the base board. The components can thus be readily assembled on an end of the coaxial cable.

BRIEF DESCRIPTION OF DRAWINGS

FIG. 5 is an exploded perspective view showing components of a feeder connector assembly in accordance with the present invention, the usual safety sleeve being omitted;

FIG. 6 is a perspective view showing the parts assembled;

FIGS. 6*a* and 6*b* are enlarged schematic illustration of details shown in FIG. 6. FIG. 7 is a front view of a feeder connector assembly in accordance with the invention.

DESCRIPTION OF CONVENTIONAL FEEDER CONNECTORS

Figure 1:
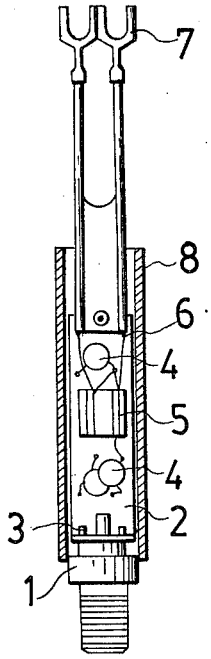
Fig. 1. PRIOR ART
FIG. 1 is a side view partially in section of a conventional feeder connection for a coaxial cable.
Figure 2:
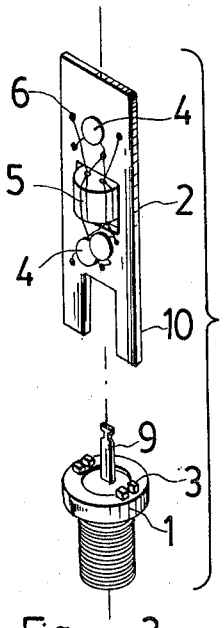
Fig. 2. PRIOR ART
FIG. 2 is a partial perspective view of the feeder connector shown in FIG. 1.

FIGS. 1 and 2 show a conventional feeder connector for coaxial cables comprising an insulated base board 2 mounted on a connector body 1 with a contact reed 9 projecting from the hollow core of the body 1. The base board has leg portions 10 which are received between pairs of spaced lugs 3 on the connector body 1 and are soldered to the connector body. A converter comprising 3 capacitors 4 and a transformer 5 is soldered onto the base board and connecting wires are soldered at 6 to terminals 7 which transform the coaxial type connection into a parallel feeder with Y-shaped terminals. A safety sleeve 8 is slipped over the assembly to avoid percussive damage. As the base board 2 is secured to the body 1 only by the two legs being soldered between the lugs 3, it is not very secure and can easily be broken off. Consequently, the cable connection is ruptured.

Figure 3:
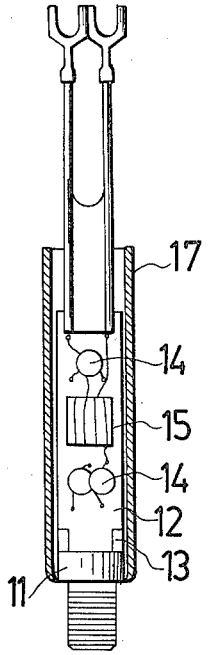
Fig. 3. PRIOR ART
FIG. 3 is a side elevation of another conventional feeder connector with a portion shown in section.
Figure 4:
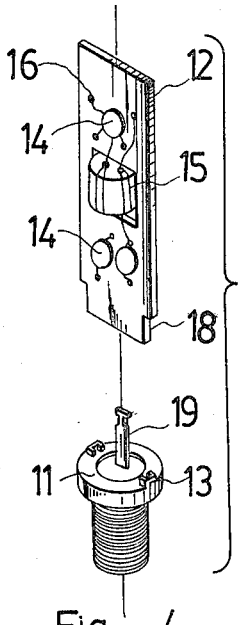
Fig. 4. PRIOR ART
FIG. 4 is a partial perspective view of the feeder connector shown in FIG. 3.

In FIGS. 3 and 4 there is shown another conventional feeder connector for coaxial cable which likewise comprises an insulated base board 12 mounted on a body 11 from which a reed 19 projects. The base board 12 is provided at its lower corners with notches 18 which are received in twin clips 13 on the outer end of the body 11. In the neighborhood of the notches 18, the insulated base board 12 is provided with a metal layer (not shown) to facilitate soldering the base board 12 to the body 11. Capacitors 14 and a transformer 15 are soldered on the insulated base board as in the embodiment of FIGS. 1 and 2 and are connected at 16 to the two terminals. The assembly is protected by a safety sleeve 17.

Both types of conventional feeder connectors use insulated PC boards on which components are mounted, it being thought that the use of metal base boards would bring unwanted effects to the magnetic properties of the transformers 5,15 and that it would unduly affect the signal reception efficiency. This concept has been proved false by the results obtained from years of experiments and studies by the applicant. It has been found instead that aberrations were mainly caused by the fixed positions of sundry elements including transformers 5,15, capacitors 4,14 and means of mounting these components and had practically nothing to do with the material of the board itself. The fact is that it is necessary to provide perforated holes in the base board beforehand whenever PC boards 2,12 are to be used and soldering can begin only after all elements are firmly set onto the respective prescribed positions. However, soldering is a time consuming and enervating job since any neglect on the part of the operator may very well be reflected in the workmanship of the product. Thus, deviation of a soldering spot by a small amount may adversely affect the reception. Since manual soldering is an unavoidable procedure in working with such base boards, there is frequent failure to meet the prescribed industrial standard. Moreover as PC boards themselves are insulators, it is necessary to provide metal plating at the soldering points in order to facilitate soldering. This in turn increases the processing steps and production costs and is an obvious disadvantage with regard to mass production.

DESCRIPTION OF PREFERRED EMBODIMENT

In accordance with the present invention as illustrated in FIGS. 5, 6, and 7, a base board 20 is formed as a sheet metal die stamping. Upper and lower clamp portions 21,22 on an upper section of the base board 20 are provided for mounting a transformer 25 between them. Small endless portions of the sheet metal are stamped out to form protruding loops 23 and 24 for the mounting of capacitors 26 on the base board. The upper section of the base board 20 is also formed into projecting lugs 27 during the punching processing which can be introduced into aligned holes 28 in a terminal board 40 which is secured to the base board by a press punching action. The terminal board 40 has two Y-type terminals 29. A lower section of the base board 20 is processed into a ring 37 which is bent at right angles and is pressed down around arcuate flanges 31 and 32 provided on the outer end of the body 30. Lugs 38 and 39 projecting inwardly from the ring 37 are pressed into notches 33 and 34 between the flanges 31 and 32 thereby further securing the base board 20 to the body 30. A contact reed 36 is affixed inside a central hole 35 in the body 30.

The structure is such that the die punching processed clamp portions 21,22 and protruding loops 23 and 24 provided on the metal base board 20 facilitate setting the transformer 25 and capacitors 26 into position without reliance on empirical trial-and-error test thus eliminating the possibility of error. Soldering is required only for the wire connections after the components have been mounted on the base board. Thus the soldering operations are greatly reduced. Moreover, the projecting lugs 27 at the top of the base board 20 and the ring 37 at the lower end with inwardly projecting lugs 38 and 39 are all formed by direct die punching. Assembly can be effected by press punching techniques once the terminal board 40 and body 30 are fitted on the base board. It thus becomes obvious that an enormous amount of time can be saved while providing a more rigidly integrating struture that better withstands external imposed forces. Once the parts have been assembled as described above, a safety sleeve can be slipped over the assembly as in the case of prior feeder connecter assemblies. The objective of the present invention is to accomplish the entire production procedure by mechanical means only, including molding of all elements involved and the assembly thereof in an integrated operation schedule designed for mass production and lowest possible production costs.

I claim:

1. Feeder connector assembly for a coaxial cable comprising a body portion for attachment to a coaxial cable and housing a contact reed, a terminal board having a pair of terminals and a base board mounting said terminal board on said body portion, said base board comprising a sheet metal die stamping having an annular inner end portion seating on said body portion and secured thereto, an outer end portion having lugs received in matching holes in the terminal board for attaching said terminal board to said base board and an intermediate portion having means for mounting a transformer and capacitor on said base board.

2. Feeder connector assembly according to claim 1, in which said body has at its outer end an interrupted annular flange comprising arcuate flange portions separated by notches, and in which said annular inner end portion of said base board embraces said flange of said body portion and has projecting portions received in said notches.

3. Feeder connector assembly according to claim 1, in which said means for mounting a transformer on said base comprises spaced clamp portions stamped out of the sheet metal of said base board and receiving a transformer between them.

4. Feeder connector assembly according to claim 1, in which said means for mounting a capacitor on said base board comprises an endless portion stamped out of the sheet metal of said base board to form a protruding loop for attachment of a capacitor.

5. Feeder connector assembly according to claim 1, in which said annular inner end portion of said base board is bent at approximately right angles to said intermediate portion.

6. Feeder connector assembly according to claim 1 in which said outer end portion of said base board is offset laterally relative to said intermediate portion.

* * * * *